US009776299B2

(12) United States Patent
Herendeen

(10) Patent No.: US 9,776,299 B2
(45) Date of Patent: Oct. 3, 2017

(54) SLIDER LEVEL LAPPING CARRIER

(71) Applicant: Seagate Technology LLC, Cupertino, CA (US)

(72) Inventor: Mark Allen Herendeen, Shakopee, MN (US)

(73) Assignee: Seagate Technology LLC, Cupertino, CA (US)

( * ) Notice: Subject to any disclaimer, the term of this patent is extended or adjusted under 35 U.S.C. 154(b) by 327 days.

(21) Appl. No.: 14/045,494

(22) Filed: Oct. 3, 2013

(65) Prior Publication Data

US 2015/0099427 A1 Apr. 9, 2015

(51) Int. Cl.

| | |
|---|---|
| ***B24B 37/30*** | (2012.01) |
| ***B24B 49/10*** | (2006.01) |
| ***B24B 37/013*** | (2012.01) |
| ***B24B 37/04*** | (2012.01) |

(52) U.S. Cl.

CPC ..... *B24B 37/013* (2013.01); *B24B 37/048* (2013.01); *B24B 37/30* (2013.01); *B24B 49/10* (2013.01)

(58) Field of Classification Search

CPC ..... B24B 37/048; B24B 37/30; B24B 37/005
USPC ..... 451/5, 8, 9, 10, 28, 364; 29/603
See application file for complete search history.

(56) References Cited

U.S. PATENT DOCUMENTS

| | | | | |
|---|---|---|---|---|
| 4,141,050 | A * | 2/1979 | Wiseley | G11B 5/6005 360/234.6 |
| 6,093,083 | A * | 7/2000 | Lackey | B24B 37/048 29/603.16 |
| 6,163,954 | A | 12/2000 | Nakagawa | |
| 6,623,652 | B1 | 9/2003 | Hsiao et al. | |
| 6,675,464 | B2 * | 1/2004 | Egawa | B24B 37/048 156/153 |
| 6,994,608 | B1 * | 2/2006 | Tzeng | G11B 5/6005 451/5 |
| 7,153,198 | B2 | 12/2006 | Fujii et al. | |
| 8,259,540 | B1 | 9/2012 | Sahoo et al. | |
| 8,451,707 | B1 | 5/2013 | Stipe | |
| 8,477,572 | B1 | 7/2013 | Sahoo et al. | |
| 2003/0199228 | A1 * | 10/2003 | Kennedy | B24B 37/048 451/11 |
| 2006/0196040 | A1 * | 9/2006 | Cyrille | B82Y 10/00 29/603.12 |
| 2007/0218807 | A1 * | 9/2007 | Mahadev | B24B 7/14 451/5 |

* cited by examiner

*Primary Examiner* — Larry E Waggle, Jr.
*Assistant Examiner* — Lauren Beronja
(74) *Attorney, Agent, or Firm* — Hall Estill Attorneys at Law

(57) ABSTRACT

A carrier may be configured and operated to engage a lapping plate with a plurality of physically separated sliders attached to a common adhesive of the carrier. The carrier can be constructed to have at least one finger adjacent to and capable of translating a single slider of the plurality of physically separated sliders.

20 Claims, 5 Drawing Sheets

SLIDER LEVEL LAPPING CARRIER

SUMMARY

In assorted and non-limiting embodiments, a carrier may engage a lapping plate with a plurality of physically separated sliders attached to a common adhesive of the carrier. The carrier can be constructed to have at least one finger adjacent to and capable of translating a single slider of the plurality of physically separated sliders

DETAILED DESCRIPTION

The current disclosure generally relates to lapping a multitude of individual sliders concurrently with a carrier engaging a lapping plate. A reduction in the physical dimensions of components in a data storage device, particularly the linear density of data bits and size of a transducing head, has corresponded with greater data storage capacity in minimal form factors. However, the increased complexity and precision associated with smaller data storage components has emphasized the accuracy of manufacturing operations. For example, slight deviations in the dimensions of a data transducing slider on a nanometer scale can jeopardize the performance and structure of the slider. Hence, equipment capable of precisely fabricating data storage components is increasingly in industry demand.

The precision of fabrication equipment and operations is further emphasized in industry by manufacturing efficiency. The individual fabrication of data transducing equipment, such as magnetoresistive stacks and air bearing floating sliders, can be expensive in terms of time, material, and complexity. For instance, conditioning the physical dimensions of individual sliders can quickly accumulate time with the loading and unloading of single sliders onto manufacturing equipment. An increase in processing, monitoring, and automation capabilities has allowed multiple individual sliders to be concurrently fabricated. In yet, such opportunities have not been met with equipment capable of utilizing the capabilities to optimize data storage component fabrication.

Accordingly, a carrier may be configured in various embodiments to engage a lapping plate with a plurality of physically separated sliders attached to a common adhesive, such as a gel-pack, of the carrier while the carrier has at least one finger adjacent to and capable of translating a single slider of the plurality of physically separated sliders. The placement of separated sliders on a gel-pack where fingers can articulate individual sliders with respect to the lapping plate allows for simultaneous, individually customized slider lapping with a single carrier. The increase in fabrication efficiency due to multiple sliders being concurrently lapped is complemented by the optimized topographical control provided by the individual fingers controlling a single selected slider.

Figure 1:
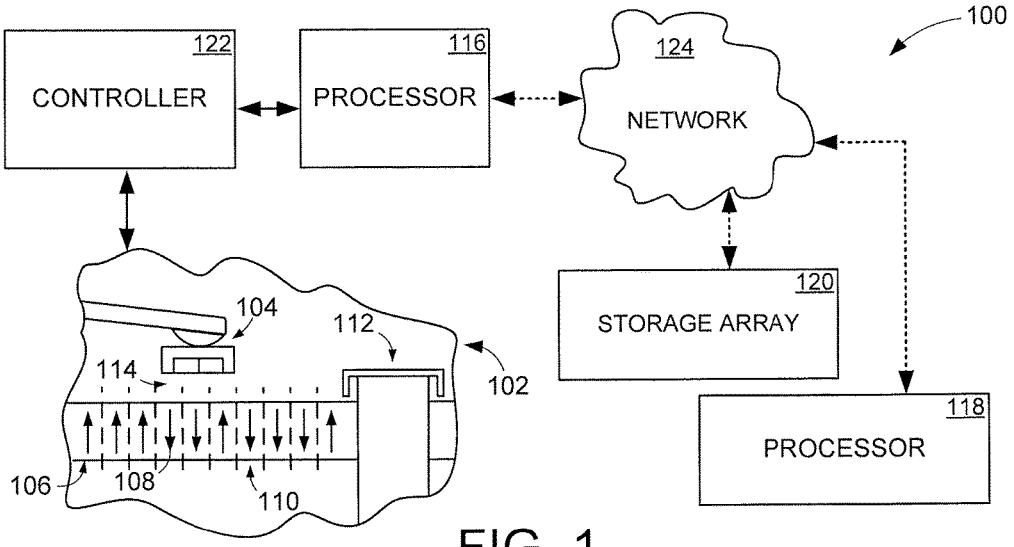
FIG. 1 is a block representation of an example data storage system.

While a data storage component, like a slider, with tuned fabrication via a carrier can be practiced in any number of data storage environments, FIG. 1 provides an exemplary data storage system 100 in which a slider is employed in accordance with some embodiments. The data storage system 100 is shown in a non-limiting configuration with a data transducing assembly 102 being equipped with a transducing head 104 that may have at least one data reading and writing means that can respectively be positioned over a variety of locations on a magnetic storage medium 106, such as over one or more stored data bits 108 that are organized in one or more predetermined patterns 110 like concentric and radial data tracks as part of a bit pattern medium.

The storage medium 106 can be attached to one or more spindle motors 112 that rotate the medium 106 to produce an air bearing 114 on which the transducing head 104 flies to access predetermined portion of the data bit patterns 110. In this way, one or more local 116 and remote 118 processors can provide controlled motion of the transducing head 104 and spindle 112 to adjust and align the transducing head 104 with selected data bits 108. The advent of remote computing has provided remote access to one or more processors 118 and storage arrays 120 from a controller 122 via a network 124. Such a wired or wireless network 124 can be used to exclusively, redundantly, and concurrently conduct data retrieval and programming operations with one or more data transducing assemblies 102, such as in an array of local and remote data storage devices interconnected by the network 124.

Figure 2:
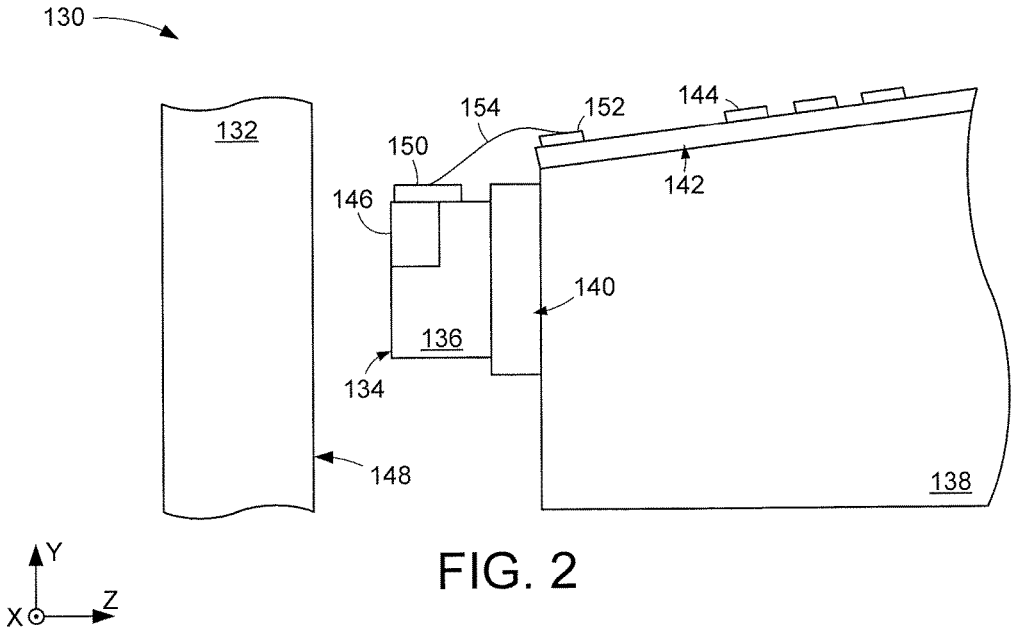
FIG. 2 displays a side view block representation of an example tooling assembly configured and operated in accordance with various embodiments.

While any component of the data storage system 100 can be tested and manufactured in an unlimited variety of manners, assorted embodiments utilize the example tooling assembly 130 of FIG. 2, which is displayed as a side view block representation. The tooling assembly 130 can have at least one tool 132 that selectively engages portions of a work surface 134 to provide a predetermined planarity. The work surface 134, in the embodiment shown in FIG. 2, is a rowbar 136 that is secured to a carrier 138 by an adhesive 140. The carrier 138 houses a probe card 142 that allows structural and operational information from the tool 132 and work surface 134 to be read via contact with an electrical contact 144.

Assorted embodiments comprise the rowbar 136 of a plurality of transducing means 146, such as a magnetoresistive sensor, that are connected by material that provides a separations distance before subsequently being processed into magnetoresistive heads after the work surface 134 is sufficiently flat due to contact with the tooling surface 148 of the tool 132. Through controlled articulation of the work surface 134 with respect to an abrasive tooling surface 148, sidewalls of one or more transducing means 146 can be shaped to be substantially planar, which allows for more accurate subsequent manufacturing and data storage performance.

Although blind engagement of the rowbar 136 and tooling surface 148 can be practiced without any real-time appraisal of the transducing means 146 structural condition, such engagement can result in too little or too much of the transducing means 146 being removed and degraded data storage performance. Hence, the amount of material removed from at least one transducing means 146 can be monitored in-situ by connecting a lapping guide pad 150 to a probe contact 152 on the probe card 142 via a wired contact 154. The continuous or routine monitoring of the amount of material being removed from the transducing means 146 through contact with the abrasive tooling surface 148 can be used to reliably provide a substantially planar transducing sidewall when the tooling surface 148 is sufficiently flat.

The advent of smaller transducing means 146 has corresponded with increased numbers of transducing means 146 populating a common rowbar 136. The greater number of transducing means 146 along with the increased precision of high data bit density, minimal form factor data storage devices has stressed the accuracy and efficiency of work surface 134 processing as well as air bearing surface processing conducted after the rowbar 136 is removed from the carrier 138.

Figure 3:
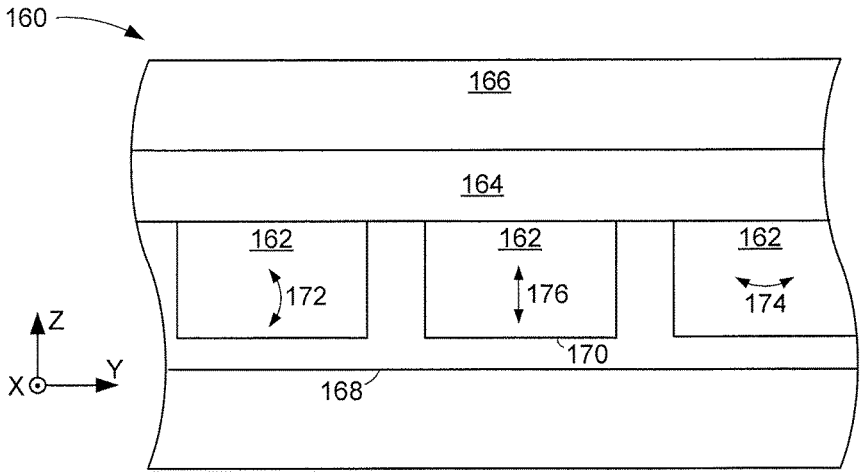
FIG. 3 provides a block representation of an example tooling system configured and operated in accordance with assorted embodiments.

FIG. 3 displays a cross-sectional block representation of an example tooling system 160 configured in accordance with assorted embodiments to allow precise slider 162 processing. After a rowbar of connected sliders are diced into individual sliders 162, a number of those sliders 162, such as forty, can be placed onto a common adhesive 164 that is resident on the slider carrier 166. The adhesive 164 is not limited to a particular material or size, but various embodiments utilize a uniform thickness of up to 10 angstroms and a material that has a predetermined hardness and rigidity to allow the placed sliders 162 to engage the tooling surface 168 with a variety of angles and pressures to shape the working surface 170 of each slider 162.

The separation of the sliders 162 by air on the common adhesive 164 allows for pressures and working angles to be customized to the respective sliders 162 via articulation of portions of the carrier 166. In contrast, sliders 162 interconnected on a rowbar that is placed on the common adhesive 164 lack the range of movement that can be complicated by residual pressure and working angles imparted on other sliders 162 along the rowbar. Hence, the ability to control at least the pitch 172 and roll 174 of the respective sliders 162 on the common adhesive 164 can allow sliders 164 to concurrently engage the tooling surface 168 with different downward pressures 178 and working angles.

As a non-limiting embodiment, each slider 162 can be placed to span at least two articulable fingers of the slider carrier 166 so that a slider 162 can experience unique pressure 176, orientation with respect to the Z axis due to rotation of the carrier 166, and orientation with respect to the X axis due to position of the respective carrier fingers. The concurrent tooling of multiple sliders with different or common design specifications can increase manufacturing precision without unduly reducing fabrication efficiency, which can be advantageous with sliders 162 having nanometer dimensions and being used in reduced form factor data storage devices.

Figure 4:
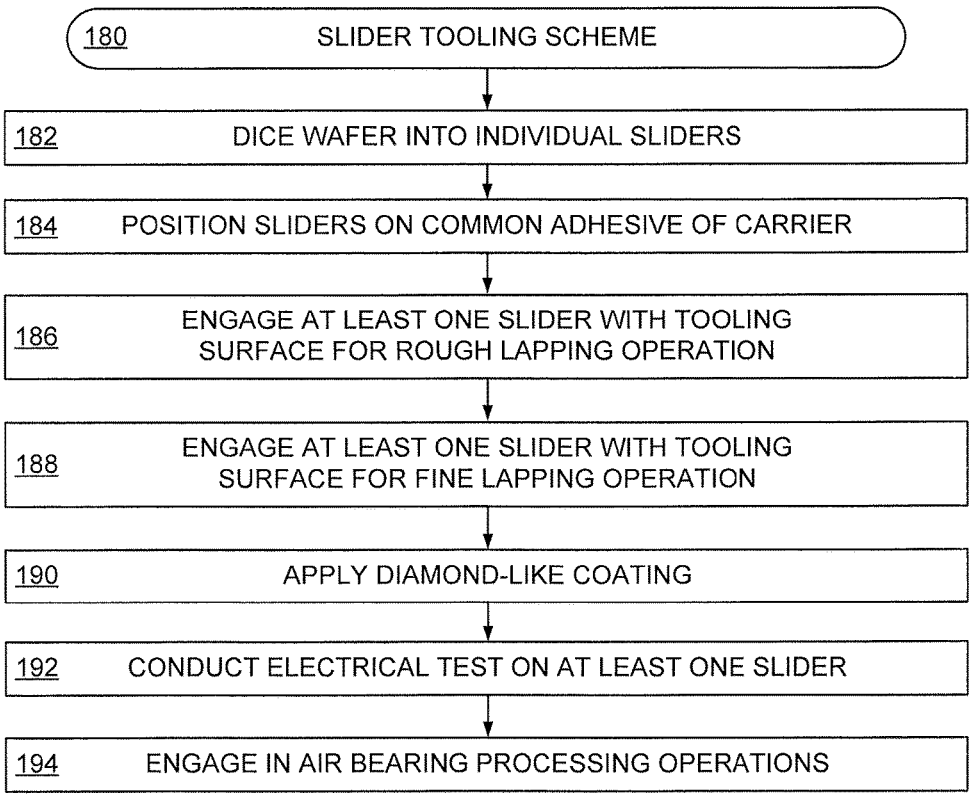
FIG. 4 provides a cross-sectional block representation of an example tooling system configured and operated in accordance with some embodiments.

While the tooling of multiple sliders 162 can be conducted in a variety of diverse manners, FIG. 4 provides an example slider tooling scheme 180 that can be carried out in accordance with some embodiments. It is contemplated that one or more slider fabrication steps, such as thin-film deposition and processing, have been completed on a common wafer before step 182 dices the wafer into individual sliders. Such dicing can replace cutting a wafer in rowbars containing multiple sliders that eventually are diced into individual sliders after at least one air bearing processing step.

With individual sliders being present, a precise pick-and-place machine can then position the respective sliders on a common adhesive of a carrier in step 184. Various embodiments can tune the position of the respective sliders to correspond to one or more articulable fingers of the carrier to allow varying degrees of slider manipulation. Next, step 186 engages at least one slider with a rough tooling surface to conduct rough lapping removal of predetermined amounts of the at least one slider. For instance, multiple sliders may be present on the carrier adhesive, but only one slider actually contacts the tooling surface before other sliders are manipulated to concurrently engage the tooling surface.

The rough lapping of step 186 is then followed by fine lapping in step 188 where at least one slider engages a fine tooling surface, which may be on a common of different substrate than the rough tooling surface, to remove material from at least one slider with greater sensitivity than the rough lapping operation of step 186. While it is possible that steps 186 and 188 can be repeated, scheme 180 advances from step 188 to step 190 where a diamond-like coating is applied. Such coating of step 190 may involve the removal and mounting of one or more sliders onto a separate carrier. The coating of step 190 proceeds to an electrical test in step 192 before air bearing processing operations are conducted in step 194 to ready the various sliders for implementation into a data storage device.

Figure 5:
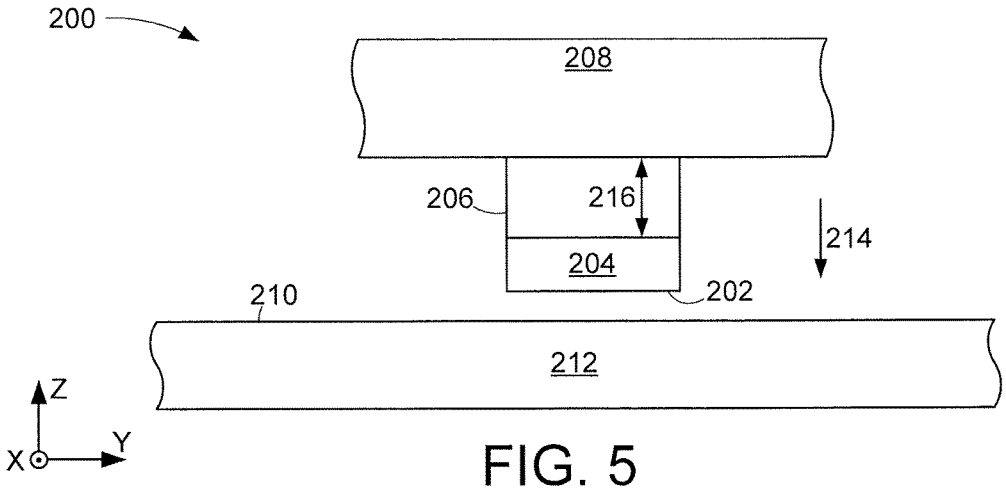
FIG. 5 maps an example tooling scheme carried out in accordance with various embodiments.

In some embodiments, sliders undergo air bearing processing by being mounted on a common adhesive of a different slider carrier. FIG. 5 illustrates an example tooling system 200 configured in accordance with some embodiments to perform air bearing surface 202 processing on at least one data transducing slider 204. While not required or limiting, the slider 204 may undergo a number of processing operations prior to placement onto a gel-pack 206 adhesive layer that connects the slider 204 to a fixture 208. Such prior processing operations may involve bar level slider 204 shaping via rough and fine lapping as part of a continuous rowbar that is subsequently diced into individual sliders 204 that are individually customized through contact with a tooling surface 210 of a lapping plate 212.

The dicing of a rowbar and shaping operations on individual sliders 204 can be tedious, but allows pressure 214 adjustments to be made on the slider 204 about the X and Y axis, respectively, along with pressure adjustments along the Z axis to provide a predetermined planarity for the air bearing surface 202 despite undulations in the tooling surface 210. As sliders 204 are reduced in physical dimensions to accommodate higher data capacities and reduced form factors, the accurate fabrication a the air bearing surface 202 with the predetermined planarity is emphasized at the expense of manufacturing time spent on setting up individual sliders on the gel-pack 206 and customizing lapping operations in-situ.

The gel-pack 206 may be configured in some embodiments to have a predetermined pliability and thickness 216 that allows for delicate kiss lapping that allows minute amounts of material removal from the air bearing surface 202 to increase overall planarity of the surface 202. That is, the gel-pack 206 is made from a material that is soft enough to undergo elastic deformation under nominal lapping operations so that minimal amounts of slider 204 material is removed. In contrast, lapping operations on a rowbar comprising a plurality of sliders can be connected to a fixture via hard adhesive, such as adhesive 140 of FIG. 2, that does not elastically deform during rough and fine lapping of the rowbar.

A kiss lapping operation may be conducted in an unlimited variety of manners, but assorted embodiments utilize a slurry of solids suspended in liquid to increase the precision of material removal. Kiss lapping may further involve timed and blind system control where the air bearing surface 202 is made to contact the tooling surface 210 for a set amount of time with predetermined conditions, like pressure along the Z axis, without knowing the real-time slider 204 operating conditions, like the amount of material removed. Conversely, monitored and actuated system controls can continuously and sporadically monitor slider 204 lapping conditions via electronic guides, such as an ELG embedded near the air bearing surface 202, and actuate slider 204 manipulating measures, such as pressure.

Regardless of the type of system control capabilities and usage during air bearing surface 202 conditioning, the ability to monitor and control various aspects of material removal allows for precise air baring surface 202 planarity conducive to tight tolerance data storage environments. However, the monotonous placement and removal of individual sliders 204 on a gel-pack 206 before and after material removal operations has stressed the timing and accuracy of kiss lapping, especially on adjustments made in-situ. Hence, many modern kiss lapping procedures are conducted blind and without actuated control at the detriment of topographical control of the air bearing surface 202.

Figure 6:
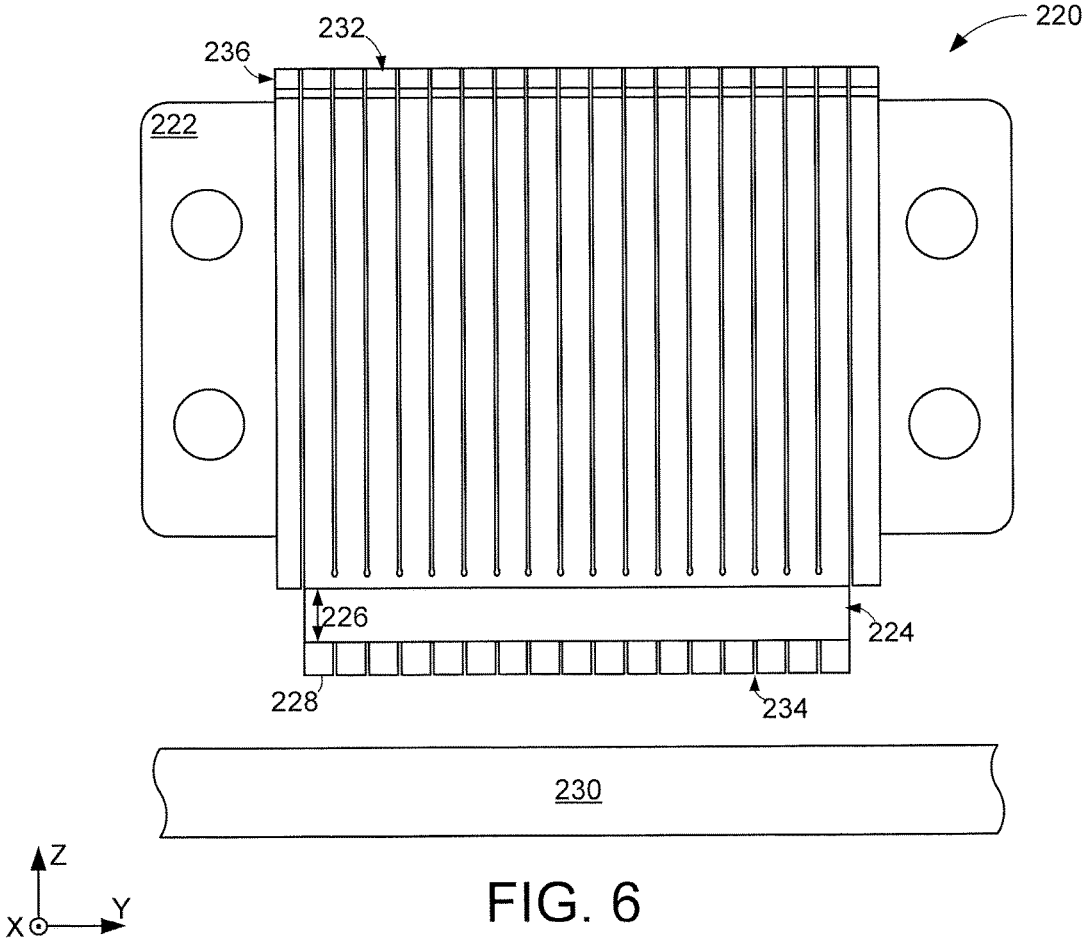
FIG. 6 illustrates a block representation of an example tool capable of being incorporated into the tooling assembly of FIG. 3.

These and other issues have rendered a kiss lapping tooling system capable of concurrently providing slider level actuated adjustments customized to separate sliders 204. FIG. 6 provides a block representation of an example tooling system 220 constructed and operated in accordance with assorted embodiments. The tooling system 220 may have, as shown, a carrier 222 with a continuous gel-pack 224 configured with a thickness 226 and pliability conducive to performing delicate kiss lapping operations via slider 228 contact with a lapping plate 230.

The placement of a plurality of sliders 228 onto the single, continuous gel-pack 224 with physically separation between adjacent individual sliders 228 allows fingers 232 to precisely control a selected one or group of sliders 228. That is, each slider 228 is physically separated from an adjacent slider 228 by an air gap 234 along the Y axis and aligned with at least one actuating finger 232 along the Z axis to allow selected articulation of individual sliders 228 with respect to the lapping plate 230. The individual selection of a slider 228 can allow different sliders 228 mounted on the common gel-pack 224 to engage the lapping plate 230 with different pressures to customize individual slider 228 position and lapping conditions with respect to the lapping plate 230.

As shown, a plurality of fingers 232 are part of a interconnected comb 236 that allows some individual finger 232 manipulation, such as 5 microns worth of travel, without overextending one or more sliders 228 and risking unwanted material removal. The interconnected configuration of the comb 236 further allows for slight adjustments in gel-pack 226 pressure and deformation that can translate to precise control of one or more sliders 228. That is, several adjacent fingers 232 can be manipulated differently to control the physical position and pressure exerted on a selected one or group of sliders 228, some of which may be offset from the fingers 232 being manipulated.

It should be noted that a finger is hereby meant within this disclosure as a rigid member mounted to the carrier 222 and positioned with the ability to translate at little as one slider 228 upon actuation of the finger 232. While a one-to-one slider-to-finger ratio can allow individual slider manipulation via articulation of a single finger 232, such configuration is not required as various comb 236 and finger 232 configurations can provide a diverse array of slider 228 and gel-pack 184 positions and operating conditions.

Figure 7:
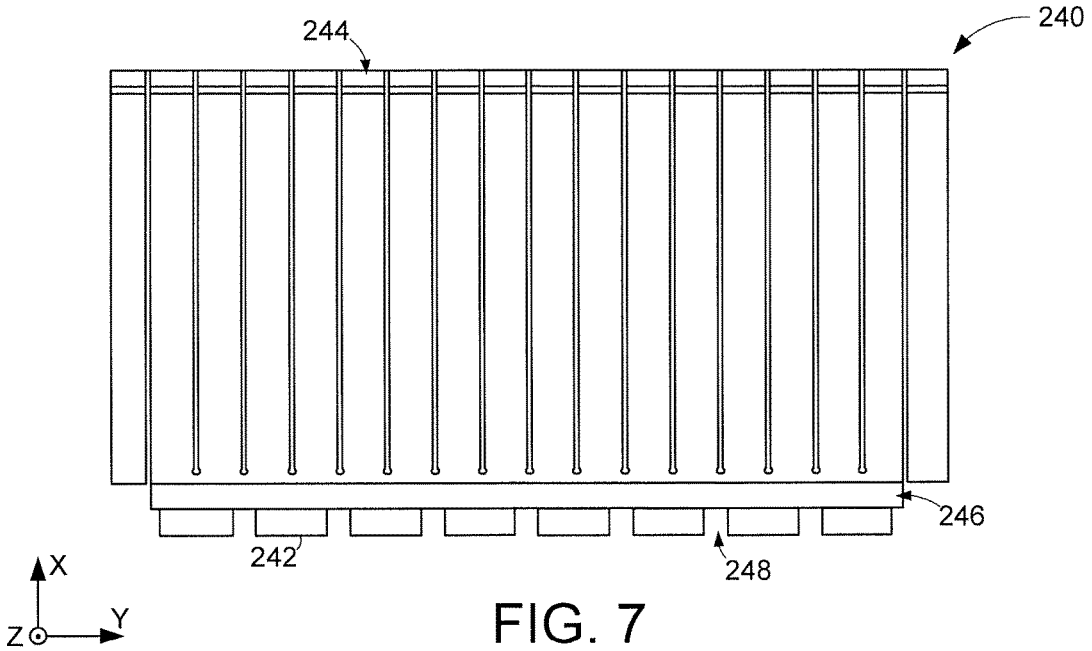
FIG. 7 shows a block representation of an example comb capable of being utilized in the tool of FIG. 4 in accordance with various embodiments.

FIG. 7 displays a block representation of an example comb 240 capable of being used in the tooling system 220 of FIG. 6 in accordance with various embodiments to concurrently fabricate multiple sliders 242 with different, customized lapping conditions. In contrast to each slider 242 being aligned with a single actuating finger 244 as illustrated in FIG. 6, the comb 240 is configured so that each slider 242 is mounted on the gel-pack 246 with a physically separating air gap 248 that positions the respective sliders 242 to span two distinct fingers 244. In other words, each slider 242 is positioned within the bounds of a pair of fingers 244 along the Y axis.

The increased number of fingers 244 with respect to the total number of sliders 242 allows for optimized slider 242 manipulation as a single finger 244 can control the physical position and lapping conditions of a smaller portion of the corresponding slider 242. The increased finger 244 resolution further allows different sliders 242 mounted on the same gel-pack 246 to undergo considerably different kiss lapping operations as articulation of various fingers 244 can be extended without affecting distal slider 242 position or pressure due to the increased number of fingers 244 compared to the number of sliders 242.

Just as the comb 240 can be configured with greater numbers of fingers 244 than sliders 242, assorted embodiments place more sliders 242 on the gel-pack 246 than number of fingers 244. Such heightened number of sliders 242 can be configured to allow individual slider positional and pressure control by manipulating adjacent fingers 244 in contrasting manners. For instance, physically adjacent fingers 244 may be actuated in opposite directions with different vector force along the X axis to translate a single selected slider 242 without translating an adjacent slider 242 on the gel-pack 246.

Figure 8:
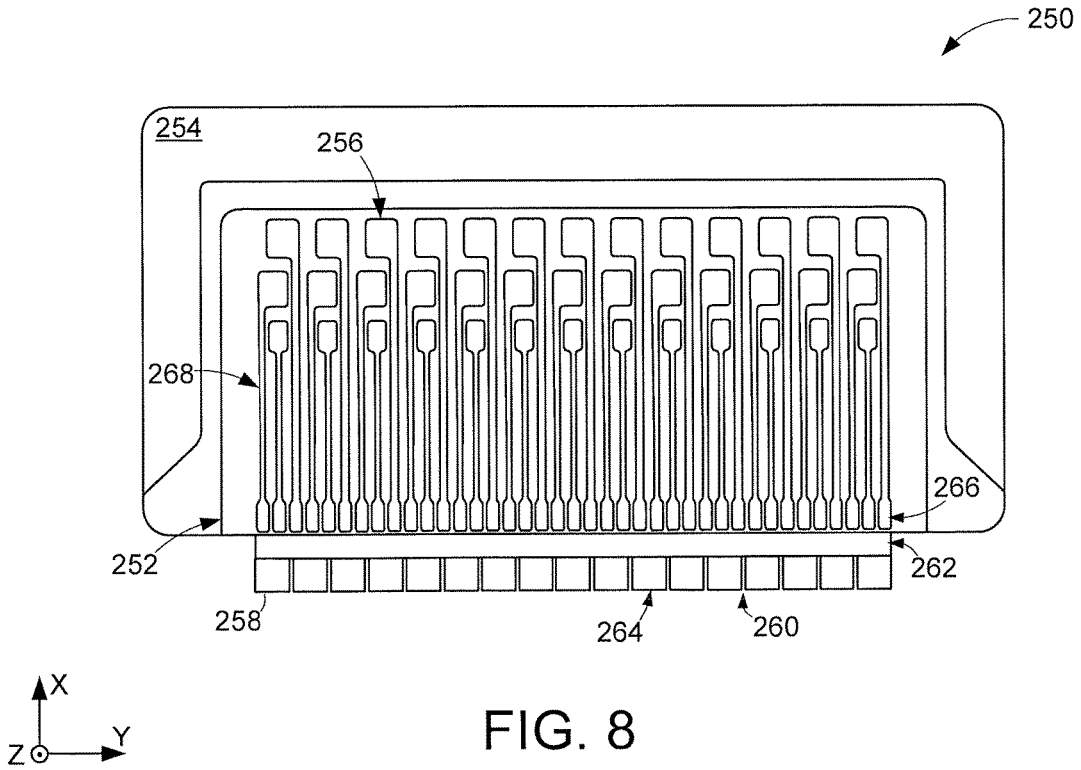
FIG. 8 shows a block representation of an example tooling fixture configured and operated in accordance with assorted embodiments.

The unlimited configurations of the comb 240 and constituent fingers 244 may be complemented by the array of different electrical connections possible with a plurality of sliders 242 being mounted to a common gel-pack 246. FIG. 8 illustrates a block representation of an example tooling fixture 250 configured in accordance with some embodiments. The fixture 210 has a probe card 252 mounted atop a probe housing 254 that can be affixed to a comb, such as comb 240 of FIG. 7, and carrier, such as carrier 222 of FIG. 6, to form a tooling assembly. The probe card 252 can be configured with one or more contact pads 256 that allow for continuous and sporadic monitoring of one or more sliders 258 separated by an air gap 260 and mounted on a common gel-pack 262.

In a non-limiting example embodiment, at least one slider 258 has an electronic lapping guide (ELG) that registers the amount of material removed from the air bearing surface 264 and is electrically connected to a guide pad 266 on the probe card 252. The plurality of guide pads 266 can allow for at least a one-to-one ratio of sliders 258 to pads 266 while assorted embodiments connect at least one slider 258 to multiple separate guide pads 266 to enable redundant and simultaneous monitoring of structural and operational slider 258 parameters, like ELG signal, pressure, temperature, and physical position. With the close physical proximity of the guide pads 266, electrical conducting leads 268 can be configured in linear and curvilinear paths to interconnect the spaced apart contact pads 256 with the guide pads 266.

The unlimited variety of electronic pad configurations on the probe card 256 can allow slider 258 fabrication to be more precise as individual sliders 258 can be monitored and tuned with the articulation of fingers, such as fingers 232 of FIG. 6. For example, electric signal monitoring of each slider 258 can pass to one or more local and remote processors via the contact pads 256 before the processors direct articulation of at least one finger to physically translate some or all of a slider 258 either towards or away from a lapping plate. Through such signal monitoring and finger articulation in view of the processed signals, the various sliders 258 mounted on the gel-pack 262 can be concurrently manipulated into varying positions, such as, but not limited to, one slider 258 being tilted about the Z axis, a different slider 258 being extended towards a lapping plate with increased pressure, and yet a different slider 258 being withdrawn so that no contact is made with the lapping plate.

Figure 9:
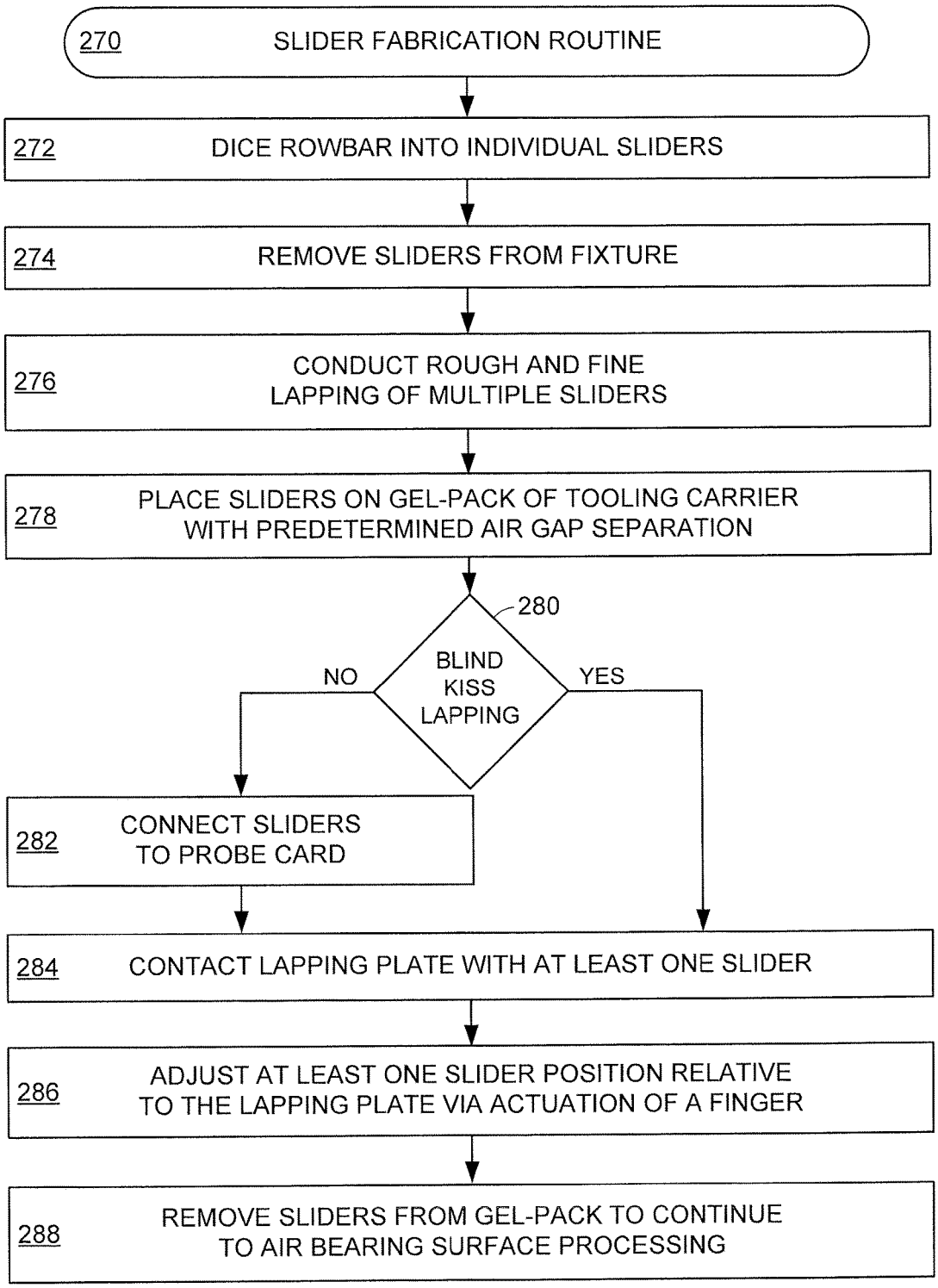
FIG. 9 provides a flowchart of a slider fabrication routine conducted in accordance with some embodiments.

It can be appreciated that with the tuned configuration of various fingers as part of a comb and various electrical pads as part of a probe card, fabrication of multiple sliders 258 simultaneously can be customized for individual sliders 258 to provide a predetermined planarity for each slider 258. FIG. 9 maps an example slider fabrication routine 270 that can be conducted in accordance with various embodiments to process several sliders concurrently. The routine 270 initially is provided with a number of magnetoresistive means in the form of sliders that have been previously processed, such as by cutting a wafer into rowbar containing multiple interconnected sliders. Step 272 then dices rowbar into individual sliders before step 274 removes the individual sliders from a dicing fixture.

Subsequently, step 276 conducts rough and fine lapping of at least one individual slider via contact of the slider and a tooling surface prior to the individual sliders being placed onto a gel-pack of a tooling carrier in step 278 with a predetermined air gap separation between the respective sliders. It can be appreciated that various cleaning and measurement steps may be conducted between steps 272 and step 278 where at least some of the sliders are placed on a common gel-pack layer of a tooling carrier with predetermined physical separation defined by an air gap.

Assorted embodiments conduct step 278 with precise pick and place equipment that allows repeatable, automated placement of sliders onto the gel-pack with enough pressure to secure the slider's position, but not too much pressure that the slider or gel-pack is damaged. As discussed above, step 278 can be carried out so that each slider is aligned with one or more fingers of a comb portion of the tooling carrier. Placement and alignment of the sliders on the gel-pack advances routine 270 to decision 280 where blind kiss lapping operations are contemplated and determined. A choice of no blind kiss lapping corresponds with monitored kiss lapping and the connection of at least one slider to an electrical pad of a probe card mounted on the tooling carrier in step 282.

Next, step 284 contacts a lapping plate with at least one slider mounted on the gel-pack of the tooling carrier. In the event blind kiss lapping was chosen in step 280, step 284 proceeds to contact at least one slider with the lapping plate without any sliders being electrically monitored or connected to a probe card. The contact of sliders and the lapping plate in step 284 may undergo a number of varying conditions, such as time, pressure, position, pitch, and roll, for different sliders as a result of planned air bearing surface fabrication. That is, a previously choreographed routine of varying positions and pressures can be conducted in step 284 with at least one actuated finger for some or all of the sliders mounted on the common gel-pack.

In various embodiments, the choreographed routine defines the entirety of slider actuation while in the embodiment shown in FIG. 9, step 286 further adjusts at least one slider position relative to the lapping plate in response to a sensed change in condition. For example, a received signal that a predetermined amount of slider material has been removed can trigger step 286 to actuate a finger and reduce pressure on a selected slider or remove the slider from contact with the lapping plate altogether.

With at least one slider having undergone a customized kiss lapping operation, step 288 removes the sliders from the gel-pack and tooling carrier and advances each slider to further air bearing surface processing. The manner and degree of further processing is not limited and can be any air bearing surface defining operations, such as the application of a diamond-like carbon layer. In some embodiments, such air bearing surface defining operations are carried out in association with step 272 and before the rowbar is diced, which would negate the further surface processing of step 288. As such, it is noted that routine 270 is not limited to the various steps and decision shown in FIG. 9 as any aspect can be omitted, changed, and added, without restriction.

Through the placement of multiple physically separate transducing sliders on a common gel-pack, aligned actuating fingers can provide customized positional articulation of individual sliders concurrently. The ability to provide customized lapping conditions for each slider mounted on a common gel-pack allows for optimized topographical control of the respective sliders that contrasts the kiss lapping of single sliders one at a time. Moreover, the use of actuated fingers during slider fabrication allows automated translation and adaptation of individual sliders to pre-choreographed routines and changing kiss lapping conditions to provide sliders with predetermined planarity with optimized efficiency.

What is claimed is:

1. An apparatus comprising a carrier configured to engage a lapping plate with a plurality of physically separated sliders attached to a common adhesive of the carrier, the carrier having first and second fingers each having a length and a width measured perpendicular to the length, the length being greater than the width and aligned parallel to a direction of pressure on the common adhesive, each finger positioned adjacent to and capable of translating a single slider of the plurality of physically separated sliders, the first and second fingers separated distal the common adhesive and connected proximal the common adhesive, the common adhesive spanning multiple fingers parallel to the width of the respective fingers and positioned on a carrier surface oriented perpendicular to the length of each finger.

2. The apparatus of claim 1, wherein the carrier houses a probe card.

3. The apparatus of claim 2, wherein each slider of the plurality of physically separated sliders is electrically connected to a contact pad of the probe card.

4. The apparatus of claim 2, wherein each slider of the plurality of physically separated sliders is electrically connected to multiple contact pads of the probe card.

5. The apparatus of claim 4, wherein the multiple contact pads are exclusively connected to a single slider of the plurality of physically separated sliders.

6. The apparatus of claim 1, wherein the common adhesive comprises a gel-pack with at least a thickness of 200 angstroms.

7. The apparatus of claim 6, wherein the gel-pack has a predetermined pliability and hardness that is less than the respective sliders of the plurality of physically separated sliders.

8. The apparatus of claim 1, wherein a slurry having a predetermined viscosity of 10-30 centipoise is present between the plurality of physically separated sliders and the lapping plate.

9. The apparatus of claim 1, wherein the plurality of physically separated sliders are separated by air on the common adhesive.

10. A method comprising:

attaching a plurality of physically separated sliders to a common adhesive of a carrier, the carrier having first and second fingers each having a length and a width measured perpendicular to the length, the length being greater than the width and aligned parallel to a direction of pressure on the common adhesive, each finger positioned adjacent to each slider of the plurality of physically separated sliders, the first and second fingers separated distal the common adhesive and connected proximal the common adhesive, the common adhesive spanning multiple fingers parallel to the width of the respective fingers and positioned on a carrier surface oriented perpendicular to the length of each finger;

translating a single slider of the plurality of physically separated sliders; and engaging the plurality of physically separated sliders with a lapping plate.

11. The method of claim 10, wherein at least one finger is actuated to translate a selected slider of the plurality of physically separated sliders towards the lapping plate.

12. The method of claim 10, wherein at least one finger is actuated to translate a selected slider of the plurality of physically separated sliders away from the lapping plate.

13. The method of claim 10, wherein at least one finger is actuated to increase a lapping pressure on a selected slider of the plurality of physically separated sliders.

14. The method of claim 10, wherein at least one finger is actuated in response to variations in elevation of the lapping plate.

15. The method of claim 10, wherein each slider of the plurality of physically separated sliders is attached to the common adhesive after a rowbar comprising multiple sliders is diced.

16. The method of claim 10, wherein the plurality of physically separated sliders engages the lapping plate for a predetermined amount of time without a slider of the plurality of physically separated sliders being monitored.

17. A method comprising:

attaching a plurality of physically separated sliders to a common adhesive of a carrier, the carrier having first and second fingers each having a length and a width measured perpendicular to the length, the length being greater than the width and aligned parallel to a direction of pressure on the common adhesive, each finger positioned adjacent to each slider of the plurality of physically separated sliders, the first and second fingers separated distal the common adhesive and connected proximal the common adhesive, the common adhesive spanning multiple fingers parallel to the width of the respective fingers and positioned on a carrier surface oriented perpendicular to the length of each finger;

translating a single slider of the plurality of physically separated sliders along pitch and roll orientations of the single slider, the pitch and roll orientations each rotating around an axis of the single slider extending parallel to a working surface of a lapping plate;

engaging the plurality of physically separated sliders with the lapping plate; and monitoring each slider of the plurality of physically separated sliders while engaged with the lapping plate.

18. The method of claim 17, wherein at least one slider of the plurality of physically separated sliders is monitored with an electronic lapping guide.

19. The method of claim 17, wherein a physical distance from the lapping plate is monitored in the monitoring step.

20. The method of claim 17, wherein at least one slider of the plurality of physically separated sliders is disengaged from the lapping plate in response to the monitoring step.

* * * * *